US007758301B2

(12) United States Patent
Bilson et al.

(10) Patent No.: US 7,758,301 B2
(45) Date of Patent: Jul. 20, 2010

(54) ARRANGEMENT FOR DETECTION OF A SHAFT BREAK IN A GAS TURBINE AS WELL AS GAS TURBINE

(75) Inventors: Christopher Bilson, Berlin (DE); Ian Fitzgerald, Eichwalde (DE)

(73) Assignee: MTU Aero Engines GmbH, Munich (DE)

( * ) Notice: Subject to any disclaimer, the term of this patent is extended or adjusted under 35 U.S.C. 154(b) by 626 days.

(21) Appl. No.: 10/587,345

(22) PCT Filed: Jul. 7, 2005

(86) PCT No.: PCT/DE2005/001206

§ 371 (c)(1),
(2), (4) Date: Jul. 25, 2006

(87) PCT Pub. No.: WO2006/005319

PCT Pub. Date: Jan. 19, 2006

(65) Prior Publication Data

US 2007/0160457 A1 Jul. 12, 2007

(30) Foreign Application Priority Data

Jul. 14, 2004 (DE) ..... 10 2004 033 924

(51) Int. Cl.
*F02C 7/00* (2006.01)

(52) U.S. Cl. ..... 415/14; 415/9; 415/118

(58) Field of Classification Search ..... 415/9, 415/13, 14, 34, 118, 173.7, 174.1; 416/2, 416/31, 61; 324/635, 644, 661, 662, 699, 324/716

See application file for complete search history.

(56) References Cited

U.S. PATENT DOCUMENTS

| | | | | |
|---|---|---|---|---|
| 1,326,867 | A * | 12/1919 | Junggren | 415/9 |
| 2,815,818 | A | 12/1957 | Douglass | |
| 2,977,758 | A | 4/1961 | Haworth et al. | |
| 3,159,166 | A | 12/1964 | Luedemann et al. | |
| 3,696,612 | A | 10/1972 | Berman | |
| 3,887,147 | A * | 6/1975 | Grieb | 244/208 |
| 3,989,408 | A | 11/1976 | Jaegtnes | |
| 4,144,421 | A | 3/1979 | Sakai | |

(Continued)

FOREIGN PATENT DOCUMENTS

| | | |
|---|---|---|
| DE | 197 27 296 | 1/1999 |

(Continued)

*Primary Examiner*—Edward Look
*Assistant Examiner*—Nathaniel Wiehe
(74) *Attorney, Agent, or Firm*—W. F. Fasse; W. G. Fasse

(57) ABSTRACT

A gas turbine machine includes a second turbine (11), e.g. a low pressure turbine, positioned downstream from a first turbine (10), e.g. a medium pressure turbine. An arrangement for detecting a shaft break of a rotor shaft includes an operator element (16) positioned between the rotor of the first turbine (10) and a stator of the second turbine (11) radially inwardly relative to a flow channel, and a sensor element (21) guided in the stator of the second turbine (11), to convert a shaft break, detected by the radially inwardly positioned operator element (16), into an electrical signal and to transmit this electrical signal to a switching element which is positioned radially outwardly relative to the flow channel on a housing of the gas turbine machine.

17 Claims, 1 Drawing Sheet

U.S. PATENT DOCUMENTS

| | | | | |
|---|---|---|---|---|
| 4,406,117 | A | 9/1983 | Rowen et al. | |
| 4,473,998 | A | 10/1984 | King | |
| 4,498,291 | A * | 2/1985 | Jeffery | 60/39.091 |
| 5,301,499 | A | 4/1994 | Kure-Jensen et al. | |
| 5,363,317 | A | 11/1994 | Rice et al. | |
| 5,411,364 | A | 5/1995 | Aberg et al. | |
| 6,494,046 | B1 | 12/2002 | Hayess | |
| 6,546,735 | B1 * | 4/2003 | Moniz et al. | 60/773 |
| 6,607,349 | B2 * | 8/2003 | Mulera et al. | 415/1 |
| 7,002,172 | B2 | 2/2006 | Rensch | |
| 7,043,896 | B2 | 5/2006 | Matthews | |
| 7,207,768 | B2 * | 4/2007 | Gordon et al. | 415/118 |
| 2008/0069685 | A1 * | 3/2008 | Bilson | 415/118 |
| 2008/0178573 | A1 | 7/2008 | Metscher | |

FOREIGN PATENT DOCUMENTS

| | | |
|---|---|---|
| GB | 903 945 | 8/1962 |
| GB | 982 292 | 2/1965 |
| GB | 1 239 349 | 7/1971 |
| GB | 1 374 988 | 11/1974 |
| GB | 2 002 857 | 2/1979 |
| GB | 2 303 225 | 2/1997 |
| JP | 03-121219 | 5/1991 |

* cited by examiner

ARRANGEMENT FOR DETECTION OF A SHAFT BREAK IN A GAS TURBINE AS WELL AS GAS TURBINE

FIELD OF THE INVENTION

The invention relates to an arrangement for detecting a shaft break in a gas turbine. Furthermore, the invention relates to a gas turbine.

BACKGROUND INFORMATION

Gas turbines constructed as aircraft engines comprise at least one compressor, at least one combustion chamber and at least one turbine. Aircraft engines are known in the prior art which on the one hand comprise three compressors positioned upstream of the combustion chamber and three turbines positioned downstream of the combustion chamber. The three compressors comprise a low pressure compressor, a medium pressure compressor and a high pressure compressor. The three turbines comprise a high pressure turbine, a medium pressure turbine and a low pressure turbine. According to the prior art, the rotors of the high pressure compressor and of the high pressure turbine are connected with each other by a shaft. The medium pressure compressor rotor and the medium pressure turbine rotor are interconnected by a shaft. The low pressure compressor rotor and the low pressure turbine rotor are interconnected by a respective shaft. The three shafts concentrically enclose one another and are therefore nested within one another.

For example, if the shaft that interconnects the medium pressure compressor with the medium pressure turbine breaks, then the medium pressure compressor can no longer take-off work or power from the medium pressure turbine. As a result, an excessive rotational speed (racing) can occur at the medium pressure turbine. Such racing of the medium pressure turbine must be avoided because thereby the entire aircraft engine can be damaged. Thus, for safety reasons a shaft break in a gas turbine must be detectable with certainty in order to stop a fuel supply to the combustion chamber when a shaft break occurs. Such a detection of a shaft break makes difficulties particularly when the gas turbine as described above comprises three shafts arranged concentrically one within the other and thus nested one within the other. In this case particularly the detection of a shaft break of the intermediate shaft which couples the medium pressure turbine with the medium pressure compressor, makes difficulties.

SUMMARY OF THE INVENTION

Starting with the foregoing it is the underlying problem of the present invention to provide a new arrangement for the detection of a shaft break in a gas turbine.

This problem has been solved by an arrangement for detecting a shaft break in a gas turbine according to the present invention. According to the invention, an arrangement is suggested for detecting a shaft break at a rotor of a first turbine particularly a medium pressure turbine of a gas turbine, particularly of an aircraft engine whereby a second turbine, particularly a low pressure turbine, is positioned downstream of the first turbine, with an operator element positioned between the rotor of the first turbine and a stator of the second turbine radially inwardly relative to a flow channel, and with a sensor element guided in the stator of the second turbine in order to convert a shaft break detected by the radially inwardly positioned operator element, into an electrical signal and to transmit this electrical signal to a switching element which is positioned radially outwardly relative to the flow channel on a housing of the gas turbine.

According to the present invention, thus an arrangement for detecting a shaft break is suggested with a mechanical operator element which is positioned radially inwardly relative to a flow channel of the gas turbine between a rotor and a stator of two neighboring turbines. A shaft break of the upstream positioned turbine is detectable with the aid of the operator element whereby the operator element is axially displaced in response to a shaft break to thereby hit the sensor element. The sensor element is preferably constructed as an impact sensor the structure of which is changed in response to an impact of the operator element on the sensor element which produces an electrical signal representing the shaft break. The sensor element is guided in the stator of the downstream positioned turbine and conducts the electrical signal representing the shaft break radially outwardly to a switching element. The sensor element can be pulled out of the assembled gas turbine in the radial direction of the same. Thereby it is assured that with an assembled gas turbine, all electrical components of the arrangement according to the invention for detecting a shaft break are easily accessible without the need for dismantling the gas turbine. The sensor element can be easily pulled out in the radial direction of the assembled gas turbine and the switching element is positioned radially outwardly on the housing of the gas turbine.

Thus, all electrical structural components of the arrangement according to the invention for detecting a shaft break can be inspected or maintained without any large maintenance effort and expense. All structural components of the arrangement according to the invention for detecting a shaft break which are accessible only by dismantling the gas turbine, for example the operating element, are of purely mechanical construction and are very reliable. Therefore, these structural components require maintenance less frequently than the electrical or electronic structural components.

The invention further provides a gas turbine having a shaft break detection arrangement as disclosed herein.

BRIEF DESCRIPTION OF THE DRAWING

In the following description, an example embodiment of the invention is described in more detail with reference to the drawing without being limited thereto. Thereby

DETAILED DESCRIPTION OF AN EXAMPLE EMBODIMENT OF THE INVENTION

Figure 1:
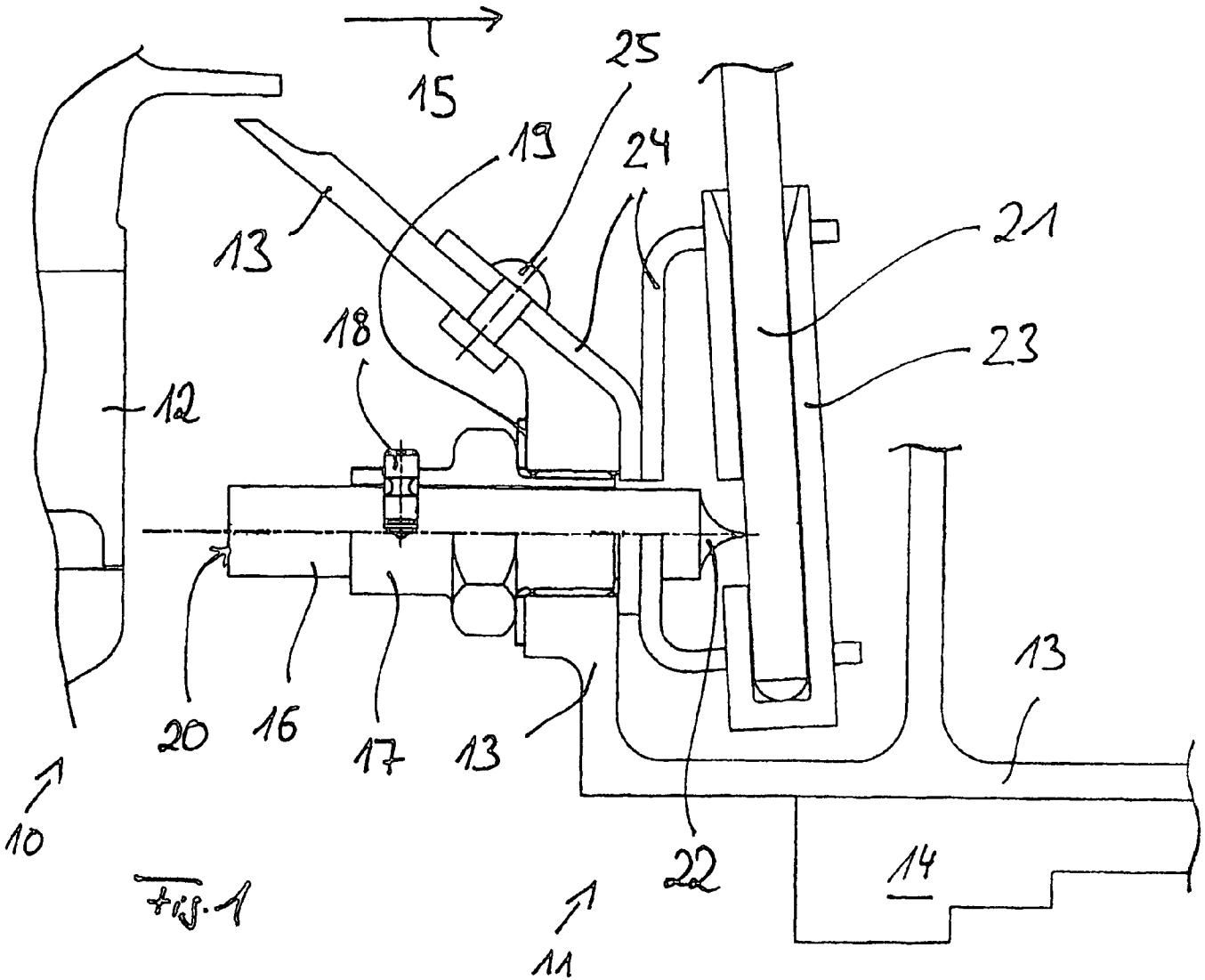
FIG. 1 shows a portion of a gas turbine according to the invention with an arrangement according to the invention for detecting a shaft break in a gas turbine.

In the following, the present invention is described in greater detail with reference to FIG. 1.

FIG. 1 shows a partial cross-section through a gas turbine according to the invention, namely an aircraft engine. The cross-section shows a radially inwardly positioned area between a rotor of a medium pressure turbine 10 and a stator of a low pressure turbine 11. A rotor disk 12 of the intermediate pressure turbine 10 is illustrated. The rotor disk 12 is part of the last rotor blade ring of the intermediate pressure turbine 10 as seen in the flow direction (arrow 15). A radially inwardly positioned sealing structure 13 of the stator of the low pressure turbine 11 is shown of the first guide vane ring of the low pressure turbine 11 as seen in the flow direction. The sealing structure 13 comprises honeycomb seals 14 of a so-called "inner air seal" sealing.

The flow direction through the gas turbine is shown in FIG. 1 by an arrow 15. Thus, the stator of the low pressure turbine 11 is positioned downstream of the rotor of the medium pressure turbine 10. Thereby, as seen in the flow direction, the first or frontmost guide vane ring of the low pressure turbine 11 borders on the last or hindmost rotor blade ring of the medium turbine 10 as seen in the flow direction. Upstream of the medium pressure turbine 10 there is preferably positioned a high pressure turbine.

As mentioned, in such gas turbines which comprise three turbines and three compressors, the rotors of the high pressure turbine and of the high pressure compressor are interconnected, the rotors of the medium pressure turbine and of the medium pressure compressor are interconnected, and the rotors of the low pressure turbine and of the low pressure compressor are interconnected respectively by a shaft. Thereby, the three shafts are arranged concentrically to enclose one another and thus are nested one within the other.

The present invention provides an arrangement for detecting a shaft break in a gas turbine, which arrangement is particularly suitable for detecting a shaft break of the shaft that interconnects the rotor of the medium pressure turbine with the rotor of the medium pressure compressor. When this shaft breaks, the medium pressure compressor can no longer take off work or power from the medium pressure turbine which leads to racing of the medium pressure turbine. Such racing of the turbine can lead to severe damages to the aircraft engine. Therefore, such a shaft break must be detected with certainty.

In accordance with the present invention it is suggested to position an operator element 16 between the rotor of the medium pressure turbine and the stator of the low pressure turbine 11. In the illustrated embodiment the operator element 16 is positioned between the last rotor blade ring of the medium pressure turbine 10, as seen in the flow direction, and the first guide vane ring of the low pressure turbine 11 also as seen in the flow direction. Thereby, the operator element 16 is positioned radially inwardly relative to a flow channel within the gas turbine and neighboring to the rotor disk 12 of the last rotor blade ring of the medium pressure turbine 10 as seen in the flow direction.

According to FIG. 1 the operator element 16 is axially oriented and guided in the sealing structure 13 serving as a sealing carrier. For this purpose a bore with an inner threading is provided in the sealing structure 13 whereby a nut 17 with a respective outer threading is secured in the bore of the sealing structure 13. The nut 17 in turn has a central bore in which the operator element 16 is guided and displaceable in the axial direction.

As shown in FIG. 1, the operator element 16 which is mounted or guided in the nut 17 for displacement in the axial direction, is fixed in an axial position by a shearable pin 18. The shearable pin 18 extends substantially in the radial direction and reaches radially from the outside through the nut 17 into a respective hole within the operator element 16. By means of the shearable pin 18 and the thereby caused axial fixing of the operator element 16 it is assured that during normal operation or regular operation of the gas turbine no axial displacement of the operator element 16 occurs.

As further shown by FIG. 1, a washer 19 is arranged between the sealing structure 13 and the nut 17. By means of the thickness of this washer 19 a spacing may be adjusted between the rotor disk 12 and an end 20 of the operator element 16 neighboring the rotor disk 12.

In addition to the operator element 16 the present invention comprises a sensor element 21 for detecting a shaft break. The sensor element 21 is constructed as an impact sensor which cooperates with the end 22 of the operator element 16 opposite the end 20 in such a way that when the second end 22 of the operator element 16 impacts on the sensor element 21 in response to a shaft break, the sensor element 21 produces an electrical signal representing the shaft break in order to transmit this electrical signal to a switching element positioned radially outwardly on a housing of the gas turbine. The sensor element 21 is guided in the low pressure turbine 11 and can be retrieved in the radial direction out of the stator of the low pressure turbine 11.

As shown in FIG. 1 the radially inwardly positioned end of the sensor element 21 is guided in a mounting 23. The mounting 23 is secured to the sealing structure 13 by a bracket 24. As shown in FIG. 1 the bracket 23 is rigidly secured to the sealing structure 13 by a rivet connection 25. The mounting 23 held by the bracket 24 has an opening in the area of the end 22 of the operator element 16 in order for the operator element 16 to be moved in the direction onto the sensor element 21 in case of a shaft break.

FIG. 1 shows the arrangement according to the invention for detecting a shaft break or rather the respective gas turbine in an arrangement corresponding to the regular or normal operation of a gas turbine. The operator element 16 is fixed by the shearable pin 18 against its axial displaceability. If a shaft break occurs on the shaft, which connects the medium pressure turbine 11 with a medium pressure compressor (not shown), then the medium pressure compressor can no longer take off work or power from the medium pressure turbine 10 and a racing of the medium pressure turbine 10 may occur. Due to the pressure conditions in the medium pressure turbine 10, in the event of such a shaft break, the rotor is moved toward the back or in the direction of the arrow 15. In that regard, the rotor is namely the rotor disk 12, shown in FIG. 1, of the last or hindmost rotor blade ring of the medium pressure turbine 10. As a result, the rotor disk 12 impacts on the end 20 of the operator element 16, whereby the pin 18 which serves for axially fixing the operator element 16, is sheared off and the operator element 16 is moved in the direction of the arrow 15 onto the sensor element 21 so that the end of the operator element 16 impacts on the sensor element 21. Hereby, the structure of the sensor element 21 is changed in such a way that an electrical signal representing a shaft break is produced by the sensor element 21. The signal can then be transmitted radially outwardly in the direction toward a switching element which finally cuts off the fuel supply to the combustion chamber in response to a shaft break.

The sensor element 21 constructed as an impact sensor preferably comprises a ceramic base body into which an electrical circuit is integrated. The structure or integrity of the base body is monitored by the switching element. When the operator element 16 impacts on the ceramic base body of the sensor element 21 in response to a shaft break, the base body is destroyed and the circuit integrated into the ceramic base body is interrupted. The change of the signal provided by the sensor element 21 occurring thereby, represents a shaft break and can be evaluated or further processed in a simple manner by the switching element in order to finally cut off the fuel supply to the combustion chamber.

As mentioned, the sensor element 21 is guided in the stator of the low pressure turbine 11 in such a manner that the sensor element 21 can be pulled in the radial direction out of the stator. Such pulling out of the sensor element 21 in the radial direction out of the stator, particularly of a guide vane of the guide vane ring of the low pressure turbine 11, can be performed with the gas engine mounted or assembled. Thereby it is possible to inspect or perform maintenance work of the sensor element 21 without any large effort. All electrical or electronic structural components of the arrangement according to the invention for detecting a shaft break are thus accessible without any large assembly effort. The remaining structural groups which are accessible only if the gas turbine is disassembled, of the arrangement according to the invention to detect a shaft break, for example the operator element 16, are of pure, mechanical construction and are very robust and thus can be inspected less frequently or maintenance work needs to be done less frequently than for the electrical or electronic structural components of the same.

The invention claimed is:

1. An arrangement for detecting a shaft break on a rotor of a first turbine (10) positioned upstream, with respect to a gas flow direction, from a second turbine (11) in a gas turbine machine, said arrangement comprising a mechanical operator element (16) positioned between the rotor of the first turbine (10) and a stator of the second turbine (11) radially inwardly relative to a gas flow channel, and a sensor element (21) guided in the stator of the second turbine (11), wherein the mechanical operator element is linearly slidably arranged between the rotor of the first turbine and the sensor element, and is located adjacent to the rotor such that the rotor will strike the operator element and linearly slide the operator element with a linear sliding motion toward the sensor element in the event of the shaft break, wherein the sensor element is arranged and adapted to convert the linear sliding motion of the operator element into an electrical signal and to transmit the electrical signal to a switching element positioned radially outwardly relative to the gas flow channel on a housing of the gas turbine, and wherein the sensor element (21) is guided in a radial direction in the stator of the second turbine (11), and is withdrawable out of the stator of the second turbine (11) in the radial direction.

2. The arrangement of claim 1, characterized in that the operator element (16) is positioned between a last rotor blade ring of the first turbine (10), as seen in the flow direction, and a first guide vane ring of the second turbine (11), as seen in the flow direction.

3. The arrangement of claim 2, characterized in that the operator element (16) is positioned radially inwardly and neighboring to a rotor disk (12) of the last rotor blade ring, as seen in the flow direction, of the first turbine (10).

4. The arrangement of claim 1, characterized in that the sensor element (21) is guided in a first guide vane ring of the second turbine (11) as seen in the flow direction.

5. The arrangement of claim 1, characterized in that the sensor element (21) is constructed as an impact sensor the structure of which is changed by an impact of the operator element (16) onto the same.

6. The arrangement of claim 1, wherein the gas turbine machine is an aircraft engine, the first turbine is a medium pressure turbine, and the second turbine is a low pressure turbine.

7. An arrangement for detecting a shaft break on a rotor of a first turbine (10) positioned upstream, with respect to a gas flow direction, from a second turbine (11) in a gas turbine machine, said arrangement comprising a mechanical operator element (16) positioned between the rotor of the first turbine (10) and a stator of the second turbine (11) radially inwardly relative to a gas flow channel, and a sensor element (21) guided in the stator of the second turbine (11), wherein the mechanical operator element is linearly slidably arranged between the rotor of the first turbine and the sensor element, and is located adjacent to the rotor such that the rotor will strike the operator element and linearly slide the operator element with a linear sliding motion toward the sensor element in the event of the shaft break, wherein the sensor element is arranged and adapted to convert the linear sliding motion of the operator element into an electrical signal and to transmit the electrical signal to a switching element positioned radially outwardly relative to the gas flow channel on a housing of the gas turbine, and wherein the operator element (16) is guided in a radially inwardly located sealing structure (13) of the stator of the second turbine (11) in an axial direction or in the flow direction, whereby the operator element (16) is fixed in the axial direction by a shearable pin (18).

8. The arrangement of claim 7, characterized in that the sensor element (21) cooperates, at a radially inwardly positioned end, with the operator element (16) in such a way that, in response to a shaft break, the operator element (16) is moved onto the sensor element (21) and hits the same while the pin (18) is sheared off, whereby the sensor element (21) generates thereof an electrical signal that represents a shaft break.

9. A gas turbine machine comprising:

a first turbine including a rotor shaft and a first turbine rotor connected to said rotor shaft;

a second turbine including a second turbine stator arranged downstream from said first turbine rotor with respect to a gas flow direction through a gas flow channel of said gas turbine machine;

a mechanical operator element that is linearly slidably mounted to said second turbine stator, and that has a first end facing toward and exposed to but spaced apart from said first turbine rotor with a spacing gap therebetween, and that has a second end opposite said first end and oriented downstream with respect to the gas flow direction; and an electromechanical sensor element mounted to said second turbine stator adjacent to said second end of said mechanical operator element;

wherein said mechanical operator element is arranged such that, if said rotor shaft breaks, then said first turbine rotor will strike said first end of said mechanical operator element and slide said mechanical operator element against said sensor element, and responsive thereto said sensor element is adapted to produce an electrical signal; and wherein said mechanical operator element is linearly slidable in an axial direction parallel to an axis of said gas turbine machine, and said sensor element is linearly radially guided in said second turbine stator to be linearly radially removable out from said gas turbine machine in a direction radial to said axial direction.

10. The gas turbine machine according to claim 9, wherein said mechanical operator element is located radially inwardly relative to said gas flow channel with respect to a central axis of said gas turbine machine.

11. The gas turbine machine according to claim 9, wherein said mechanical operator element is positioned between a last rotor blade ring of said first turbine rotor, as seen in the gas flow direction, and a first guide vane ring of said second turbine stator, as seen in the gas flow direction.

12. The gas turbine machine according to claim 9, wherein said mechanical operator element is positioned radially inwardly and neighboring to a rotor disk of a last rotor blade ring of said first turbine rotor, as seen in the gas flow direction.

13. The gas turbine machine according to claim 9, wherein said sensor element is guided in a first guide vane ring of said second turbine stator, as seen in the gas flow direction.

14. The gas turbine machine according to claim 9, wherein said sensor element comprises an impact sensor having a structure that is adapted to be changed by an impact of said mechanical operator element onto said impact sensor.

15. The gas turbine machine according to claim 9, wherein said gas turbine machine is an aircraft engine, said first turbine is a medium pressure turbine, and said second turbine is a low pressure turbine.

16. A gas turbine machine comprising:

a first turbine including a rotor shaft and a first turbine rotor connected to said rotor shaft;

a second turbine including a second turbine stator arranged downstream from said first turbine rotor with respect to a gas flow direction through a gas flow channel of said gas turbine machine;

a mechanical operator element that is linearly slidably mounted to said second turbine stator, and that has a first end facing toward and exposed to but spaced apart from said first turbine rotor with a spacing gap therebetween, and that has a second end opposite said first end and oriented downstream with respect to the gas flow direction; and an electromechanical sensor element mounted to said second turbine stator adjacent to said second end of said mechanical operator element;

wherein said mechanical operator element is arranged such that, if said rotor shaft breaks, then said first turbine rotor will strike said first end of said mechanical operator element and slide said mechanical operator element against said sensor element, and responsive thereto said sensor element is adapted to produce an electrical signal; and wherein said second turbine stator includes a radially inwardly located sealing structure, said gas turbine machine further comprises a shearable pin, said mechanical operator element is guided in said sealing structure in an axial direction or in the gas flow direction, and said mechanical operator element is fixed in the axial direction by said shearable pin.

17. The gas turbine machine according to claim 16, wherein a radially inner end portion of said sensor element cooperates with said mechanical operator element and said shearable pin such that if said rotor shaft breaks, then said first turbine rotor will strike said first end of said mechanical operator element thereby shearing off said shearable pin and sliding said mechanical operator element against said sensor element and responsive thereto said sensor element is adapted to produce the electrical signal representing the break of said rotor shaft.

* * * * *